US011867482B2

(12) United States Patent
Ludewigt

(10) Patent No.: US 11,867,482 B2
(45) Date of Patent: Jan. 9, 2024

(54) DIRECTED-ENERGY WEAPON AND METHOD FOR DISPLAYING THE POSITION OF AN IMPACT POINT OF THE DIRECTED-ENERGY WEAPON

(71) Applicant: Rheinmetall Waffe Munition GmbH, Suedheide OT Unterluess (DE)

(72) Inventor: Klaus Ludewigt, Hamburg (DE)

(73) Assignee: RHEINMETALL WAFFE MUNITION GMBH, Suedheide OT Unterluess (DE)

( * ) Notice: Subject to any disclaimer, the term of this patent is extended or adjusted under 35 U.S.C. 154(b) by 368 days.

(21) Appl. No.: 17/240,807

(22) Filed: Apr. 26, 2021

(65) Prior Publication Data

US 2022/0307803 A1 Sep. 29, 2022

Related U.S. Application Data

(63) Continuation of application No. PCT/EP2019/079143, filed on Oct. 25, 2019.

(30) Foreign Application Priority Data

Oct. 26, 2018 (DE) ..... 10 2018 126 833.5

(51) Int. Cl.
*F41H 13/00* (2006.01)
*F41G 3/32* (2006.01)

(52) U.S. Cl.
CPC ..... *F41H 13/0062* (2013.01); *F41G 3/323* (2013.01)

(58) Field of Classification Search
CPC ..... F41G 3/165; F41G 3/323; F41H 13/005; F41H 13/0062
See application file for complete search history.

(56) References Cited

U.S. PATENT DOCUMENTS 3,752,587 A 8/1973 Myers et al.
4,155,096 A * 5/1979 Thomas ..... G01S 3/7864 244/3.13

(Continued)

FOREIGN PATENT DOCUMENTS

DE 10 2012 022 039 A1 5/2014
EP 3 182 193 A1 6/2017

(Continued)

OTHER PUBLICATIONS

Japanese Office Action dated Jun. 30, 2023 in corresponding application 2021-522016.

*Primary Examiner* — Thanh Luu
(74) *Attorney, Agent, or Firm* — Muncy, Geissler, Olds & Lowe , P.C.

(57) ABSTRACT

A method and apparatus for displaying a position of an impact point of a directed-energy weapon which has an effective beam optical system and an imaging optical system. An emission of primary radiation of the directed-energy weapon is triggered as an effective beam, and radiation exiting from an irradiated object is received by the imaging optical system and directed onto a camera of a screen. A beam bundle cross section of an effective beam is covered with a reflective optical auxiliary element, the effective beam or the auxiliary beam is triggered with the beam bundle cross section covered, and primary radiation of the effective beam or of the auxiliary beam which is reflected by the reflective optical auxiliary element is received by the imaging optical system and directed onto a spot of the camera as the impact point.

14 Claims, 3 Drawing Sheets

(56) References Cited

U.S. PATENT DOCUMENTS

| | | | | |
|---|---|---|---|---|
| 10,180,492 | B2 | 1/2019 | Protz | |
| 2010/0282942 | A1 | 11/2010 | Mosier et al. | |
| 2014/0307440 | A1 | 10/2014 | Geldek et al. | |
| 2015/0293210 | A1 | 10/2015 | Protz | |
| 2017/0234658 | A1* | 8/2017 | Segev | F41H 13/0062 250/203.2 |

FOREIGN PATENT DOCUMENTS

| | | | |
|---|---|---|---|
| GB | 2 165 957 | A | 4/1986 |
| JP | 2006189256 | A | 7/2006 |

* cited by examiner

DIRECTED-ENERGY WEAPON AND METHOD FOR DISPLAYING THE POSITION OF AN IMPACT POINT OF THE DIRECTED-ENERGY WEAPON

This nonprovisional application is a continuation of International Application No. PCT/EP2019/079143, which was filed on Oct. 25, 2019 and which claims priority to German Patent Application No. 10 2018 126 833.5, which was filed in Germany on Oct. 26, 2018 and which are both herein incorporated by reference.

BACKGROUND OF THE INVENTION

Field of the Invention

The present invention relates to a method for displaying an actual impact point of a directed-energy weapon and to a directed-energy weapon.

Description of the Background Art

A method and a directed-energy weapon are known in the conventional art per se. The conventional method relates to a directed-energy weapon which has an effective beam optical system and an imaging optical system. The effective beam optical system is used to focus and align primary radiation that is emitted by the directed-energy weapon in the form of an effective beam or an auxiliary beam. Radiation exiting from an object irradiated with the effective beam or the auxiliary beam is received by the imaging optical system and directed onto a camera of a screen which has a target point marking.

The imaging optical system is an example of target optical system that is used for the optical display of a target region. Another example of such target optical system is a telescopic sight that allows the target region to be viewed directly with the eye. The target point of the weapon is usually marked by a crosshair in the optical system of the telescopic sight or on a camera screen. The target point marked as a crosshair, for example, indicates a target impact point located in the target region when the target region is viewed through the telescopic sight or the target region depicted on a screen. The method for displaying an actual impact point is also referred to as "target point determination."

When a fire is carried out, the weapon is first aligned in such a way that the crosshair of the target optical system or the target point coincides with the target impact point. Then the shot is triggered. The accuracy of the weapon depends on how well the crosshair or the target impact point/target point corresponds to the actual impact point of the weapon that was actually hit when a shot was fired.

A good match between the target point and the actual impact point is of great importance, particularly for directed-energy weapons, since directed-energy weapons in principle have a very high level of precision. This precision can only be used, however, if the crosshair of the target optical system or the target point coincides with the actual impact point of the weapon with an accuracy corresponding to the precision of the directed-energy weapon.

An adjustment of the imaging optical system that leads to the desired correspondence requires the determination of the actual impact point. Such a determination of the actual impact point is required, for example, when assembling a weapon for the first time, after an exchange of parts of the weapon, or after a misalignment of the structure due to environmental influences such as temperature and pressure fluctuations, vibrations, shock waves, etc.

In the case of conventional firearms, the position of the actual impact point relative to the target impact point is determined with the aid of sharp shots of the weapon at a test target on which the actual impact point is presented as a bullet hole, for example. The resulting hole is then aimed at with the target optical system of the weapon and the crosshair of the target optical system is set to the actual impact point, which is presented as a bullet hole, while the orientation of the weapon remains unchanged. This procedure is repeated several times to increase the accuracy. It may be necessary to repeat this procedure for other target distances.

This is also the conventional procedure for a directed-energy weapon. The analogue to the sharp shot of the conventional firearm is here a high-power laser beam which is directed at a test target and there, for example, creates a penetration into the material of the test target. The burn-in point is received with the imaging optical system, and the target point of the directed-energy weapon (e.g. the intersection point of a crosshair of an imaging optical system) is adjusted, while the alignment of the weapon remains unchanged, so that the target point lies on the burn-in point displayed as an actual impact point when viewing the burn-in point with the target optical system.

In the conventional method, in order to display the position of an impact point of a directed-energy weapon having an effective beam optical system and an imaging optical system, a primary radiation of the directed-energy weapon focused and directed by the effective beam optical system is triggered as an effective beam or auxiliary beam.

The object irradiated with this effective beam or auxiliary beam emits radiation which in the following is only referred to as radiation to distinguish it from the output radiation of the directed-energy weapon, which is referred to as primary radiation. This radiation is, for example, a broad spectrum of visible light and/or infrared radiation, which may be emitted as a result of exposure to the primary radiation, but can also be reflected daylight, for example. This radiation is received by the imaging optical system and directed onto a camera on a screen. The burn-in point is shown on the screen as the actual impact point. The screen has, for example, a target point marking in the form of a crosshair, so that the position of the impact point can be read relative to the target point marking.

In the conventional method, sharp shots/irradiation of test targets is required in the real range of the weapon for the target point determination. For this purpose, a suitable terrain with appropriate safety precautions is required for the use of weapons. Another disadvantage is that this target point determination is very difficult when the weapon is in motion. A movement of the weapon can hardly be avoided in the case of ship weapons, for example.

It is also disadvantageous that the method may not be feasible in the operation region of the weapon if it is not a restricted region. Then, for example, after a weapon repair, an exact target point determination of the directed-energy weapon is not possible.

SUMMARY OF THE INVENTION

It is therefore an object of the present invention to provide a method and a directed-energy weapon that do not suffer from the above disadvantages.

In an exemplary embodiment, this object is achieved in that a beam bundle cross section of an incident effective beam or auxiliary beam exiting from the directed-energy weapon is covered by an optical auxiliary element reflecting the effective beam or the auxiliary beam. The effective beam or the auxiliary beam is then triggered with the beam bundle cross section covered, so that the primary radiation propagating in this beam bundle cross section hits the optical auxiliary element and is reflected by it. The primary radiation of the effective beam or of the auxiliary beam which is reflected by the reflective optical auxiliary element is received by the imaging optical system and directed onto a spot of the camera. This spot is displayed on the screen as the determined actual impact point.

The housing can be adapted to be closed in a lightproof manner. This ensures that no laser radiation can escape when the method is carried out, so that no safety measures are necessary.

The target point of the directed-energy weapon can be determined and displayed without primary radiation having to be emitted into the environment in the form of an effective beam or auxiliary beam. The determination and display of the target point can be carried out at any time with a high degree of accuracy, little expenditure of time, and without safety precautions relating to the region around the directed-energy weapon, such as barriers, for example. Another advantage is that the target point of the directed-energy weapon can be determined and displayed even when the directed-energy weapon is moving, without the movement of the directed-energy weapon impairing the accuracy of the determination and display of the target point.

The directed-energy weapon can have a primary radiation source and at least one radiation-guiding solid body having a first end and a second end as well as a first wavelength splitter or beam splitter which is a common component of the imaging optical system and the effective beam optical system, wherein the first end is arranged relative to the primary radiation source in such a way that the primary radiation emitted by the primary radiation source can be coupled into the solid body via the first end and can be decoupled from the solid body via the second end and in that the wavelength splitter or beam splitter is arranged in a beam path of the primary radiation that can be decoupled such that it can be illuminated with the primary radiation that can be decoupled.

Also, the method also works without such a solid body if the laser beam is introduced into the optical system as a free beam (adjustment to the optical axis of the optical system). The laser beam can then be coupled into the optical system as a collimated beam, i.e. a beam of light aligned in parallel. Coupling in a divergent beam is also conceivable. Coupling in as a free beam has advantages in the case of very high powers, since the power levels that can be transmitted with fibers known today are limited.

The effective beam optical system and the imaging optical system can have optical elements as further common components which are located between the wavelength splitter or beam splitter and an effective beam exit opening of the directed-energy weapon.

The optical elements can have a common optical axis.

The common optical elements ensure that the target plane is imaged sharply on the camera and the screen.

The further common optical elements can include at least a first telescopic optical system and a second telescopic optical system.

The optical auxiliary element can be a flat mirror which is arranged perpendicular or substantially perpendicular to the optical axis.

The optical auxiliary element can have a retroreflector which is configured to reflect incident primary radiation as reflected primary radiation in directions opposite to directions of the incident primary radiation.

The effective beam optical system and the imaging optical system can have a deflecting mirror as a further common component, which is arranged and aligned in such a way that it reflects primary radiation incident from the wavelength splitter or beam splitter in the direction of the effective beam exit opening and reflects reflected radiation incident from the direction from the optical auxiliary element to the wavelength splitter or beam splitter.

The wavelength splitter or beam splitter can direct at least part of the reflected radiation incident from the deflecting mirror onto at least one camera of the imaging optical system.

The imaging optical system can have a first camera and a second camera and a second wavelength splitter or beam splitter that separates reflected radiation incident from the first wavelength splitter or beam splitter into a reflected portion and a transmitted portion and that the first camera is arranged such that it can be illuminated with the reflected portion and that the second camera is arranged such that it can be illuminated with the transmitted portion.

Also, a single camera, for example, is sufficient to carry out the method. Usually, this will be a so-called fine tracking camera. The images from this camera are evaluated by software with regard to the target position in relation to the beam position (=crosshair), the offset is calculated, and a control signal for the deflecting mirror is output.

A second (or additional) camera(s) can be used independently of the first camera. The method then delivers the target point (crosshair) for this camera at the same time as the first camera. The second camera may use a different wavelength so that the optical paths are separated by a wavelength splitter mirror. Sometimes, the software evaluation does not allow the images to be available to the observer. Then the second camera can be used for observation. Under certain circumstances, the second wavelength can provide better images because the atmospheric conditions are different (less scattering, fog). A second camera can have a higher resolution, an optical system with higher magnification for better resolution or with smaller magnification for a larger image field.

The alignment of the deflecting mirror can be adjusted manually or automatically.

An optical element (lens or spherical mirror) can be arranged between the wavelength splitter or beam splitter and a deflecting mirror and that a further optical element (lens or spherical mirror) is arranged between the deflecting mirror and the second wavelength splitter or beam splitter and that a second deflecting mirror is arranged between the second wavelength splitter or beam splitter and the first camera.

The imaging optical system and the effective beam optical system can be arranged in a housing, which has an effective beam exit opening allowing radiation to exit the housing and allowing radiation to enter the housing, and that the optical auxiliary element in the form of a cover closing the effective beam exit opening can be fastened to an edge of the effective beam exit opening.

The optical auxiliary element can be fastened so as to be captive and foldable via a hinge, the optical auxiliary element leaving the effective beam exit opening free in a first folded position and closing the effective beam exit opening in a second folding position.

The features mentioned above and those yet to be explained below can be used not only in the respectively given combination but also in other combinations or in isolation, without departing from the scope of the present invention.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
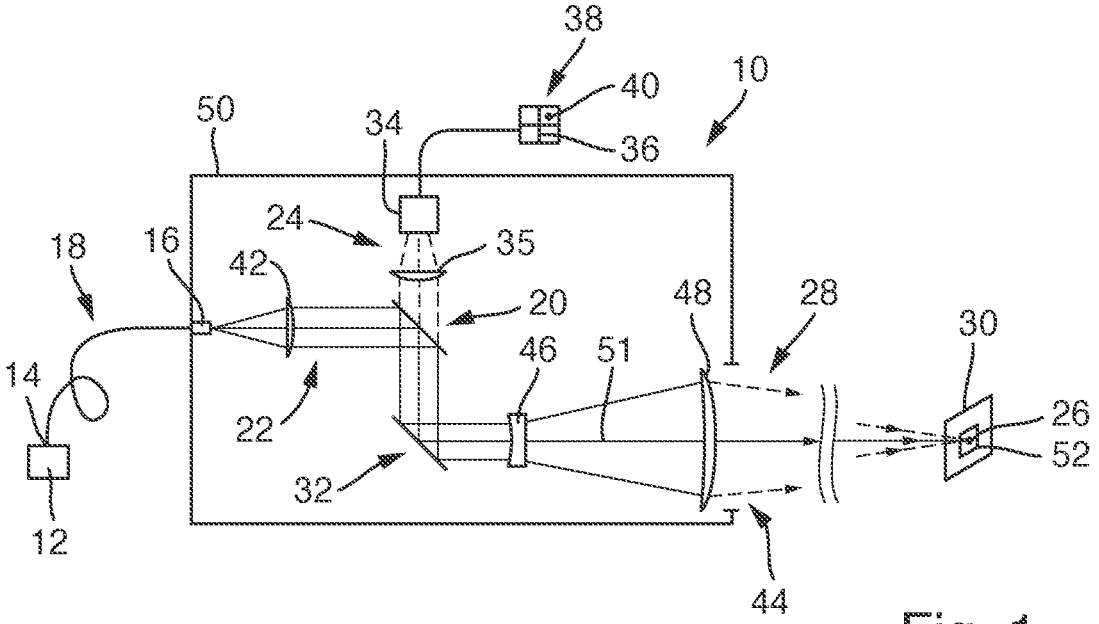
FIG. 1 is a simplified illustration of a directed-energy weapon as a technical environment of the invention with outgoing radiation.

In detail, FIG. 1 shows a simplified illustration of a directed-energy weapon 10. The directed-energy weapon 10 has a primary radiation source 12 and at least one radiation-guiding solid body 18 having a first end 14 and a second end 16 as well as a first wavelength splitter or beam splitter 20. The primary radiation source 12 preferably has one or more lasers. The radiation-guiding solid body 18 is, for example, a glass fiber or a glass fiber bundle.

The directed-energy weapon 10 has an effective beam optical system 22 and an imaging optical system 24 and is configured to display the position of an impact point 26 of the directed-energy weapon 10. The effective beam optical system 22 is configured to focus and align the primary radiation of the directed-energy weapon 10 to be emitted as an effective beam 28 or an auxiliary beam into a target plane 30. The alignment is carried out, for example, by a movable deflecting mirror 32.

The imaging optical system 24 is configured to receive radiation exiting from an object irradiated with the effective beam 28 or the auxiliary beam and to direct it to a camera 34 of a screen 38 having a target point marking 36. For this purpose, the directed-energy weapon 10 has a screen 38. In this case, an enlarged high-resolution image 40 of the impact point 26 is preferably generated on the camera 34 and the screen 38. In addition to the camera 34 and the screen 38, the imaging optical system 24 has an imaging optical system 35 as an optical element that is not also associated with the effective beam optical system.

The first wavelength splitter or beam splitter 20 is a common component of the imaging optical system 24 and the effective beam optical system 22. The wavelength splitter or beam splitter 20 is based on, for example, inversion of wavelength coupling. Such wavelength splitters (=wavelength couplers in reverse) are known. Known wavelength splitters have a special mirror layer that has been vapor-deposited onto a glass substrate. This layer reflects light with wavelengths from a specific wavelength range and transmits light with wavelengths from a different wavelength range. Such mirrors are known to a person skilled in the art and are commercially available (e.g. from Laseroptik, Garbsen)

In the subject matter of FIG. 1, the wavelength splitter or beam splitter 20 reflects the wavelength of the effective laser and transmits the wavelength of the illumination laser (auxiliary laser). The illumination laser is an independent laser that is moved along with it so that it illuminates the target region with the target over a large area (like a headlight). Alternatively, it is also possible to work without an illumination laser and at any wavelength for the camera image if there is enough daylight. Theoretically, the camera could also be a thermal camera; and it is possible to work with thermal radiation in the near or far infrared.

In principle, it is also possible to generate the camera image in a wavelength range in which the effective laser wavelength lies. The element 20 is then not a wavelength splitter but a beam splitter. This means that the element 20 reflects a lot of light (99%) (namely the laser) and only allows a small part (1%) to pass through to the camera.

In general, however, wavelength splitters working according to other principles can also be used.

The first end 14 of the radiation-guiding solid body 18 is arranged relative to the primary radiation source 12 in such a way that the primary radiation emitted by the primary radiation source 12 can be coupled into the solid body 18 via the first end 14, and the second end 16 is arranged relative to the first wavelength splitter or beam splitter 20 such that primary radiation propagating in the solid body 18 can be decoupled of the solid body 18 via the second end 16 and that the first wavelength splitter or beam splitter 20 can be illuminated with the primary radiation that can be decoupled. A collimation optical system 42 arranged between the second end 16 and the first wavelength splitter or beam splitter 20 bundles the primary radiation exiting from the second end 16. The collimation optical system 42 is an optical element of the effective beam optical system 22 that does not belong to the imaging optical system 24.

The imaging optical system 24 and the effective beam optical system 22 are arranged in a housing 50. The housing 50 has an effective beam exit opening 44 which allows radiation to exit the housing 50 and allows radiation to enter the housing 50.

In addition to the first wavelength splitter or beam splitter 20 and the deflecting mirror 32, the effective beam optical system 22 and the imaging optical system 24 have further common optical elements that are located between the first wavelength splitter or beam splitter 20 and the effective beam exit opening 44. The further common optical elements are at least a first telescope optical system 46 and a second telescope optical system 48. The common optical elements have a common optical axis 51. Due to their common optical axis 51, the common optical elements ensure that the target plane 30 (laser focus plane) is imaged sharply on the camera 34.

As mentioned at the outset, during the conventional determination of the target point 26, a test target 52 is irradiated, which is located at a great distance, for example at a distance of several hundred meters or a few kilometers, from the directed-energy weapon 10.

FIG. 1 shows a directed-energy weapon 10 with an effective beam 28 or auxiliary beam which is directed at a distant test target 52 and creates a burn-in point there. This burn-in point, which marks the actual impact point 26, is received by the camera 34 of the imaging optical system 24 and is displayed as an image 40 of the impact point 26 on the screen 38.

Figure 2:
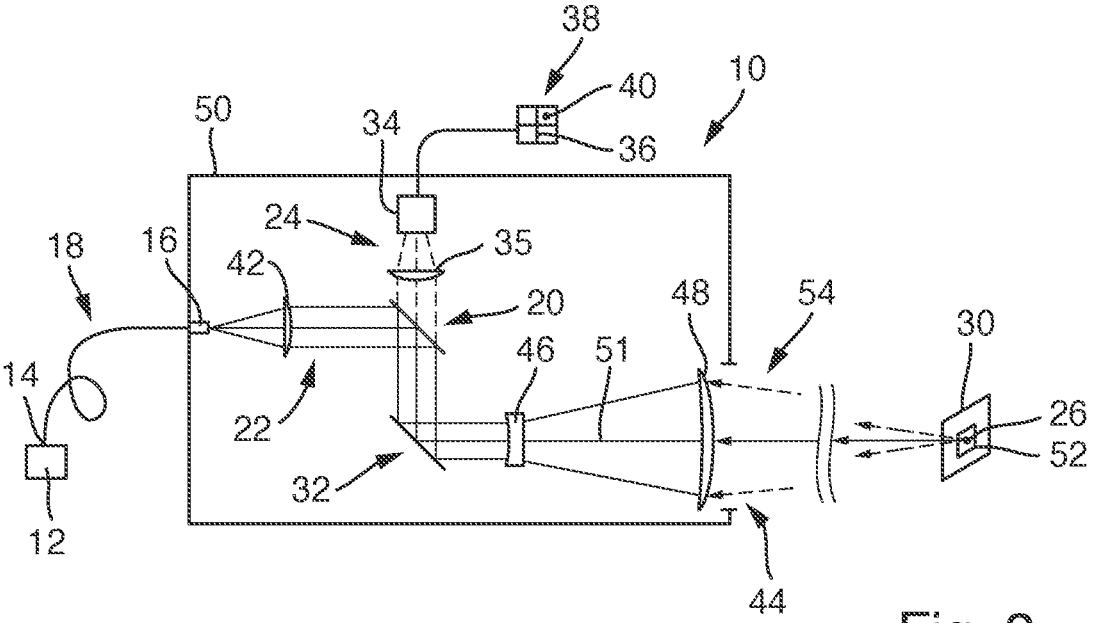
FIG. 2 shows the directed-energy weapon from FIG. 1 with incoming radiation.

FIG. 2 shows the directed-energy weapon from FIG. 1 with a beam path of radiation 54 which exits from the test target 52 in the opposite direction to the effective beam 28 and enters the imaging optical system 24 of the directed-energy weapon 10 through the effective beam exit opening 44 of the directed-energy weapon 10. This radiation 54 is, for example, visible light or infrared radiation. This radiation can arise as a result of irradiation with the primary radiation, but it can also be emitted independently of the primary radiation, for example as temperature radiation or reflected daylight.

FIG. 1 shows that the second end 16 of the radiation-guiding solid body, which to a certain extent illustrates the source of the primary radiation for the directed-energy weapon 10, is imaged in the target plane 30 by a first image. The first image is conveyed by the effective beam 28. The image lying in the target plane 30 corresponds to the impact point 26 on the test target 52.

FIG. 2 shows the same structure as FIG. 1 with a beam path in the opposite direction. FIG. 2 thus makes it clear that this impact point 26 is imaged sharply on the camera 34 in a second optical image by the imaging optical system 24 and is displayed as an image 40 of the impact point 26 on the screen 38. This twofold optical image can be viewed as an indirect image of the second end 16 of the radiation-guiding solid body 18.

Figure 3:
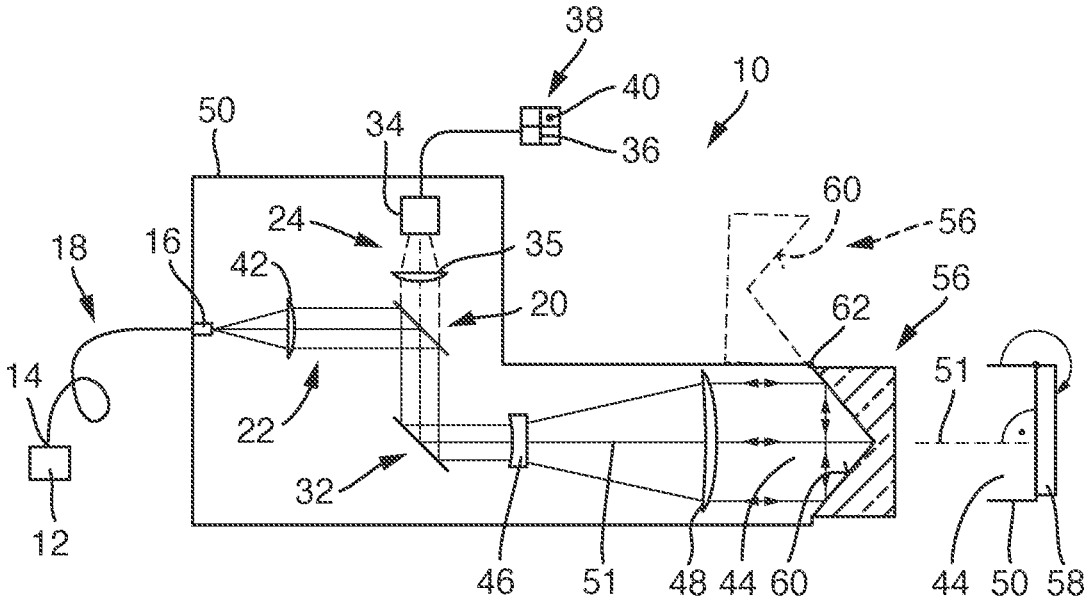
FIG. 3 shows an embodiment of a directed-energy weapon according to the invention.

FIG. 3 shows an embodiment of a directed-energy weapon 10. This directed-energy weapon 10 has all of the elements of the directed-energy weapon 10 explained with reference to FIGS. 1 and 2 and differs from it by an additional optical auxiliary element 56.

This optical auxiliary element 56 is distinguished by the fact that, due to its shape, dimensions, and arrangement, it is configured to cover a beam bundle cross section of an effective beam 28 or auxiliary beam exiting from the directed-energy weapon 10 and to reflect primary radiation directed out of the directed-energy weapon 10 into the imaging optical system 24 of the directed-energy weapon 10. The imaging optical system 24 is configured to receive primary radiation of the effective beam 28 or the auxiliary beam reflected by the reflective optical auxiliary element 56 and to direct it as an image of the second end 16 onto the camera 34, and to display this image as the impact point 40 on the screen 38.

In one embodiment, the optical auxiliary element 56 is a flat mirror 58 which is arranged perpendicular to the optical axis 51. For this purpose, the mirror must reflect the beam exactly in itself. To do this, the mirror would have to be precisely adjusted in angle, which is not easy.

A retroreflector 60 is therefore preferably used as an auxiliary element: The retroreflector reflects the beam into itself without adjusting the angle. A retroreflector is a device that reflects incident electromagnetic radiation largely independently of its direction of incidence and the orientation of the retroreflector in the direction from which the radiation is incident. An incident beam is reflected laterally offset by 180°. Such a retroreflector 60 is therefore configured to reflect incident primary radiation as reflected primary radiation in directions opposite to directions of the incident primary radiation.

To carry out the method, it is sufficient to reflect back only part of the beam (the rest then hits the cover). This means that the retroreflector can have a much smaller diameter than the beam diameter.

The retroreflector does not necessarily have to be positioned in the center of the beam; a small retroreflector is also possible in the outer beam region.

FIG. 3 shows a large retroreflector (region corresponds to the clear width of the housing opening) which is centered on the beam. This solution provides perhaps the greatest accuracy. But it also works with a small retroreflector that is not centered. For example, it is sufficient to glue a small retroreflector to the inside of the cover. The cover was then closed in a lightproof manner for the method. Since there are no angle or position requirements for the retroreflector, the method can be carried out immediately without any adjustments.

The optical auxiliary element 56 can preferably be fastened to an edge of the effective beam exit opening 44 in the form of a cover that closes the effective beam exit opening 44. Such a fastening can be carried out in various ways, for example by screws or clamps. In any case, the fastenings must be detachable.

In a preferred embodiment, the optical auxiliary element 56 is fastened in a captive and foldable manner to the housing 50 via a hinge 62. In this case, the optical auxiliary element 56 leaves the active beam exit opening 44 free in a first folding position, and closes the effective beam exit opening 44 in a second folding position. The first folding position is represented in FIG. 3 by the dashed illustration of the optical auxiliary element 56. The second folding position is represented in FIG. 3 by the solid-line illustration of the optical auxiliary element 56. The reflective side of the optical auxiliary element 56 is arranged on the side of the optical auxiliary element 56 which faces the interior of the housing 50 in the closed state. As an alternative to the rotatable cover described, other designs are also possible, such as a slide closure or a closure that swings away to the side. The closure is preferably constructed in such a way that the housing is closed in a lightproof manner when the method is carried out. The closure of a cover closing the housing is preferably monitored in a safety-relevant manner. This ensures that no laser radiation can escape when the method is carried out, so that no safety measures are necessary.

In contrast to FIGS. 1 and 2, which together show an indirect image of the beam exit of the primary radiation onto a camera 34, FIG. 3 shows a direct optical image of the beam exit of the second end 16 (or the beam exit of an auxiliary beam collinear to the effective beam) onto the camera 34. The direct optical imaging takes place with the aid of the optical auxiliary element 56. For this purpose, the optical auxiliary element 56 is arranged directly in front of the effective beam exit opening 44 of the directed-energy weapon 10 and reflects the effective beam 28 exiting from the effective beam exit opening 44 along the optical axis 51 into the common part of the imaging optical system 24 and the effective beam optical system 22. The direction of the beams incident on the optical auxiliary element 56 is reversed during the reflection on the optical auxiliary element 56, so that the reflected radiation in the imaging optical system 24 propagates to the camera 34 as if this radiation originated from a remote test target located in a distant test target-side focal point of the effective beam 28.

The direct imaging thus takes place in such a way that the direct optical image of the beam exit of the effective beam or auxiliary beam (i.e. of the second end 16) corresponds to the image of the impact point 26 of the effective beam 28 on a distant test target 52. The image of the second end 16 generated in this way can therefore be used to determine and display the actual impact point.

This optical method can be carried out in such a way that the effective beam 28 does not leave the housing 50, so that no test station is required for carrying out the method and no safety precautions need to be taken.

In the case described here, the effective beam of one or more lasers is guided to the effective beam optical system with a glass fiber or a bundle of glass fibers. In this case, the optical image is equivalent to the image of the second end 16, at which the primary radiation exits from a fiber end face. In this case, a laser beam with a different wavelength (auxiliary beam, pilot laser) can also be used for direct imaging on the camera.

In an alternative embodiment, the laser beam is guided from the laser beam source to the optical system without a fiber. The laser beam is then introduced into the optical system as a free beam. The adjustment then takes place on the optical axis of the optical system. As a rule, the laser beam is then coupled into the optical system as a collimated beam of parallel light. The collimation optical system (42) is then omitted. The coupling in of a divergent beam is also conceivable.

Figure 4:
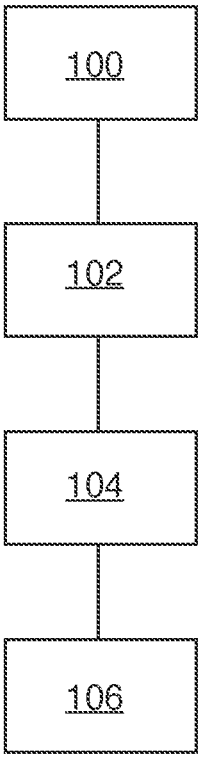
FIG. 4 is a flow chart as an embodiment of a method according to the invention.

FIG. 4 shows a flowchart as an embodiment of a method according to the invention for displaying the position of an impact point of a directed-energy weapon 10 having an effective beam optical system 22 and an imaging optical system 24.

In a first step 100, a beam bundle cross section of an effective beam 28 or auxiliary beam exiting from the directed-energy weapon 10 is covered with an optical auxiliary element 56 reflecting the incident effective beam 28 or auxiliary beam.

In a second step 102, the effective beam 28 or the auxiliary beam is triggered when the beam bundle cross section is covered.

In a third step 104, radiation exiting from an object irradiated with the effective beam 28 or the auxiliary beam is received by the imaging optical system 24 and directed onto a camera 34 of a screen 38 which has a target point marking 36. In the prior art, the irradiated object is a remote test target 26. In the present invention, the object is the optical auxiliary element 56.

In a fourth step 106, the radiation spot generated by the camera 34 is displayed as the actual impact point 40 on the screen 38.

Figure 5:
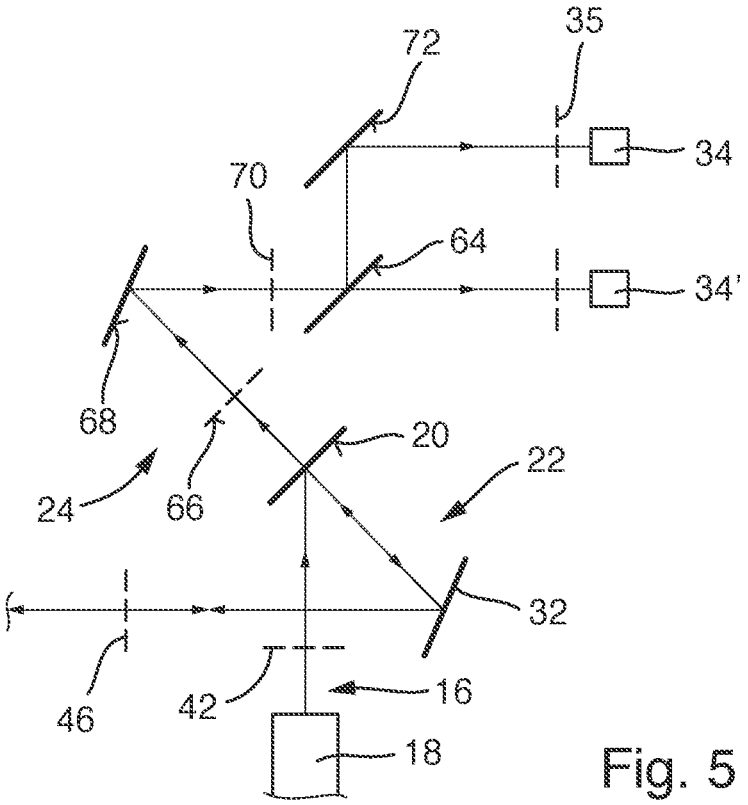
FIG. 5 shows a further embodiment of a directed-energy weapon according to the invention.

A further embodiment of a directed-energy weapon according to the invention is explained below with reference to FIG. 5.

The effective beam optical system 22 and the imaging optical system 24 have the deflecting mirror 32 as a common component, which is arranged and aligned in such a way that it reflects primary radiation incident from the first wavelength splitter or beam splitter 20 in the direction of the first telescope optical system 46 and reflects reflected radiation incident from the direction from the optical auxiliary element 56 to the first wavelength splitter or beam splitter 20.

The first wavelength splitter or beam splitter 20 directs at least part of the reflected radiation incident from the deflecting mirror 32 onto at least one camera 34, 34' of the imaging optical system.

The imaging optical system has a first camera 34 and a second camera 34' and a second wavelength splitter or beam splitter 64 that separates reflected radiation incident from the first wavelength splitter or beam splitter 20 into a reflected portion and a transmitted portion.

The first camera 34 is arranged such that it can be illuminated with the reflected component, and the second camera 34' is arranged such that it can be illuminated with the transmitted component.

The alignment of the deflecting mirror 32 can be adjusted manually or automatically in one embodiment. An optical element 66 is arranged between the first wavelength splitter or beam splitter 20 and a deflecting mirror 68. Another optical element 70 is arranged between the deflecting mirror 68 and the second wavelength splitter or beam splitter 64. A second deflecting mirror 72 is arranged between the second wavelength splitter or beam splitter 64 and the first camera. The optical elements can each be implemented as a lens or as a spherical mirror. The telescope optical system, the collimation optical system, and the imaging optical system can also each be implemented as lenses or spherical mirrors.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A directed-energy weapon comprising:

an effective beam optical system;

an imaging optical system, wherein the directed-energy weapon is configured to display a position of an impact point of the directed-energy weapon, wherein the effective beam optical system is configured to focus and align a primary radiation of the directed-energy weapon to be emitted as an effective beam or auxiliary beam, and wherein the imaging optical system is configured to receive radiation exiting from an object irradiated with the effective beam or the auxiliary beam and to direct the radiation to a camera; and a reflective optical auxiliary element with which a beam bundle cross section of an effective beam or auxiliary beam exiting from the directed-energy weapon is adapted to be covered, and with which the primary radiation directed out of the directed-energy weapon is adapted to be reflected, wherein the imaging optical system is configured to receive the primary radiation of the effective beam or of the auxiliary beam reflected from the reflective optical auxiliary element and to direct such onto a spot of the camera, and to display the spot as an impact point on a screen, and wherein the imaging optical system and the effective beam optical system are arranged in a housing, which has an effective beam exit opening allowing radiation to exit the housing and allowing radiation to enter the housing, and wherein the reflective optical auxiliary element in the form of a cover closing the effective beam exit opening is adapted to be fastened to an edge of the effective beam exit opening.

2. The directed-energy weapon according to claim 1, wherein the directed-energy weapon further comprises:

a primary radiation source and at least one radiation-guiding solid body having a first end and a second end;

a wavelength splitter or beam splitter, wherein the first end is arranged relative to the primary radiation source such that the primary radiation emitted by the primary radiation source is adapted to be coupled into the solid body via the first end and is adapted to be decoupled from the solid body via the second end, and wherein the wavelength splitter or beam splitter is arranged in a beam path of the primary radiation that is adapted to be decoupled such that the wavelength splitter or beam splitter is adapted to be illuminated with the primary radiation that is adapted to be decoupled.

3. The directed-energy weapon according to claim 2, wherein the effective beam optical system and the imaging optical system have optical elements as further common components which are located between the wavelength splitter or beam splitter and the effective beam exit opening of the directed-energy weapon.

4. The directed-energy weapon according to claim 3, wherein the optical elements have a common optical axis.

5. The directed-energy weapon according to claim 4, wherein the further common optical elements comprises a first telescopic optical system and a second telescopic optical system.

6. The directed-energy weapon according to claim 4, wherein the reflective optical auxiliary element is a flat mirror that is arranged substantially perpendicular to the optical axis.

7. The directed-energy weapon according to claim 2, wherein the effective beam optical system and the imaging optical system have a deflecting mirror as a further common component, which is arranged and aligned such that the deflecting mirror reflects primary radiation incident from the wavelength splitter or beam splitter in a direction of the effective beam exit opening and reflects reflected radiation incident from the direction from the reflective optical auxiliary element to the wavelength splitter or beam splitter.

8. The directed-energy weapon according to claim 7, wherein the wavelength splitter or beam splitter directs at least part of the reflected radiation incident from the deflecting mirror onto at least one camera of the imaging optical system.

9. The directed-energy weapon according to claim 8, wherein the imaging optical system comprises a first camera and a second camera and a second wavelength splitter or beam splitter that separates reflected radiation incident from the wavelength splitter or beam splitter into a reflected portion and a transmitted portion, and wherein the first camera is arranged so that the first camera is adapted to be illuminated with the reflected portion, and wherein the second camera is arranged such that the second camera is adapted to be illuminated with the transmitted portion.

10. The directed-energy weapon according to claim 9, wherein an optical element is arranged between the wavelength splitter or beam splitter and a deflecting mirror, and wherein a further optical element is arranged between the deflecting mirror and the second wavelength splitter or beam splitter, and wherein a second deflecting mirror is arranged between the second wavelength splitter or beam splitter and the first camera.

11. The directed-energy weapon according to claim 10, wherein the optical element is a lens or spherical mirror.

12. The directed-energy weapon according to claim 8, wherein the alignment of the deflecting mirror is adjusted manually or automatically.

13. The directed-energy weapon according to claim 1, wherein the reflective optical auxiliary element has at least one retroreflector that is configured to reflect an incident primary radiation as reflected primary radiation in directions opposite to directions of the incident primary radiation.

14. The directed-energy weapon according to claim 1, wherein the reflective optical auxiliary element is fastened so as to be captive and foldable via a hinge, the reflective optical auxiliary element leaving the effective beam exit opening free in a first folding position and closing the effective beam exit opening in a second folding position.

* * * * *